United States Patent [19]

Tsui et al.

[11] 4,100,447

[45] Jul. 11, 1978

[54] ADDRESSING OF GAS DISCHARGE DISPLAY DEVICES

[75] Inventors: Frank Tsui; Katherine Tsui, both of Holzgerlingen, Germany

[73] Assignee: International Business Machines Corporation, Armonk, N.Y.

[21] Appl. No.: 598,223

[22] Filed: Jul. 23, 1975

[30] Foreign Application Priority Data

Jul. 25, 1974 [DE] Fed. Rep. of Germany ..... 2435745

[51] Int. Cl.[2] ..... H01J 61/00

[52] U.S. Cl. ..... 313/217; 313/188; 313/220; 315/169 TV

[58] Field of Search ..... 313/220, 217, 188; 315/169 TV

[56] References Cited

U.S. PATENT DOCUMENTS 3,993,921 11/1976 Robinson ..... 313/220 X

*Primary Examiner*—Rudolph V. Rolinec
*Assistant Examiner*—Darwin R. Hostetter
*Attorney, Agent, or Firm*—Joseph J. Connerton

[57] ABSTRACT

For the decoupling between drive lines 9 for applying the firing and extinguishing pulses and supply lines 7 for supplying the sustain voltage, as well as for firing and maintaining discharges in gas discharge display devices, electrodes 2 are applied via conductive multi-layer zones 3 of the surrounding dielectric layer 4, from the supply lines 7 and also via counter-plates provided on the surface of the dielectric layer 4. The counter-plates are interconnected by lines 9, and form with associated counter-electrodes, respective capacitors in which one counter-plate vertical row can represent a first coordinate while the second coordinate may be formed by time-defined shifting of this vertical row of counter-plates in a direction which is vertical with respect to its extension. If instead of a linear displacement of the counter-plate row, there is an angular displacement round a fixed center of rotation, a planar coordinate image display representation may be formed which is advantageous in cases of displays covered by rotating scanning elements such as, for example, radar systems.

20 Claims, 13 Drawing Figures

ADDRESSING OF GAS DISCHARGE DISPLAY DEVICES

BACKGROUND OF THE INVENTION

Figure 1:
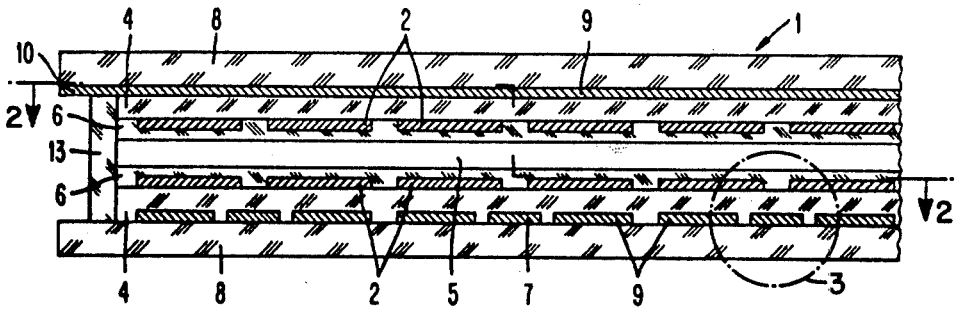

Plasma display devices of this type are generally addressed via the coordinate drive lines by firing or erasing signals respectively, a sustain signal being applied via the same coordinate lines to maintain a continuous display.

In one embodiment of the sustain signal, an alternating voltage is continuously applied to the coordinate lines so that each half-period of the sustain voltage at the discharge gaps previously fired the combined influence of the sustain voltage on the wall voltages built up at dielectric electrode layers, there is a new firing. Upon the new firing of the discharge gaps with accompanying light emissions the wall charges, at each of the discharge gaps, are again generated but in a polarity which is opposite to the preceding one, until the gas discharge at the discharge gap is again extinguished temporarily. The sustain voltage of opposite polarity in the subsequent half-period again fires for a short time the discharge gap with a simultaneous re-charging of the wall charge which in turn extinguishes again the gas discharge. This process is repeated until an extinguishing pulse for suppressing a subsequent ignition is applied.

Formerly known embodiments of gas discharge display devices do not show any decoupling components on the substrates themselves which include the laminar discharge chamber. Consequently, components and circuit elements for the decoupling have to be housed separately outside the substrates which generally necessitates a considerable structural and manufacturing expenditure. In order to avoid this it is the object of the invention to provide a gas discharge display device permitting an uncomplicated manufacture and which during operation ensures an efficient decoupling between sustain voltage supply lines and firing and extinguishing pulse lines, as well as between the inidividual discharge gaps.

According to the invention this problem is solved in that the respective discharge gaps are defined by individual electrodes which, on the one hand, are connected via zones of low electric conductivity in at least one of the substrates encompassing the discharge chamber, to the sustain voltage supply line, and which on the other hand are capacitively coupled via highly insulating zones in a first dielectric layer on the respective substrate, to the firing or extinguishing pulse supply lines.

It is thus advantageously achieved that the necessary decoupling measures are directly contained in the indicating arrangement and are presented simultaneously with the latter's manufacture, so that the above mentioned decoupling elements, components, and circuit elements as well as their fixing and connecting measures are no longer required.

If the sustain voltage is applied in the form of alternating or pulse voltages, respectively, it is advisable to cover the electrodes towards the discharge chamber by a second dielectric layer in order to permit the formation of wall charges.

When the display device in accordance with the invention is used with a sustain voltage in DC operation the second dielectric layer is no longer required, which permits a further simplification of manufacture.

In an advantageous improvement the sustain voltage supply lines are each provided at each second space between two electrode columns in that two electrode columns are provided to one respective sustain voltage supply line.

The arrangement in accordance with the invention can basically be realized in two embodiments. In the first case it is provided that on a non-conductive substrate parallel sustain voltage supply lines and thus alternatingly firing or extinguishing pulse supply lines are arranged, and that thereon the first dielectric layer is applied which shows alternatingly highly insulating zones substantially carrying the electrodes, and poorly insulating zones contacting the electrodes of two respective adjacent electrode columns. It can advantageously be provided that the firing or extinguishing pulse supply lines provided above or beneath the electrode columns on the first dielectric layer are each planar-wise extended directly above the individual electrodes in order to achieve in that manner a maximum planar zone as a counter-plate to the respective circular electrode for forming a respective coupling capacity.

In the second case, it can be provided in an advantageous improvement of the invention that the substrate itself is of low conductivity and that the sustain voltage supply lines are on one plane with the electrodes on the substrate, the sustain voltage supply lines being arranged in parallel on both substrates, and being provided in an interleaved manner from substrate to substrate, i.e. in alternating spaces between the electrode columns. Such an embodiment presents the advantage, when sustain voltages are used in the form of alternating voltages, that only a single dielectric layer has to be applied which is required for generating the wall charges. Here, too, it can be advantageously provided that the firing or extinguishing pulse supply lines above each electrode are planar-wise extended so that the firing of extinguishing pulses can be applied via maximum coupling capacities.

In an advantageous embodiment of the invention it is provided that the sustain voltage supply lines are on ground potential on one of the substrates, and that the electrodes of this substrate serve each as a counter-plate for one of the plates coupled to the firing and extinguishing pulse sources, said plates being provided on an element displaceably arranged to said substrate in a series which is substantially transverse to the displacement direction, thus forming with the respective opposite electrodes coupling capacities as a function of the position of the element. This permits greater flexibility in the use of the display device in accordance with the invention, as the capacitive coupling of the firing pulses or the extinguishing pulses, respectively, can take place in a corresponding dependence of the supply of measured values to be displayed, as required for instance in radar devices, control indicator boards, etc.

Via corresponding wiper devices provided in the substrate frame on the one hand and in the displaceable element on the other, in a manner known per se, supply voltages as well as firing and/or extinguishing pulses can be transmitted to the displaceable element which in turn, in an advantageous design, is equipped with registers, drivers, and latches in an integrated circuit manner, as they are required for addressing the gas discharge gaps. With measures of that type the number of supply lines to the displaceable element can thus be restricted to a minimum.

This system in accordance with the invention in turn can be realized in two embodiments, i.e. on the one hand that a linear displacement of the element can be performed, and on the other that in the case of a circular design of the substrates surrounding the laminar discharge chamber an angular displacement of the element towards the polar coordinate position is provided. The latter embodiment is advantageously suitable for use with small radar devices.

An advantageous driving means of the circular element consists in that a peripheral drive co-acting therewith is provided which advisably can consist of several friction-coupled driving wheels. The disk rim of the element turnable in its angular position can be of such a design that the necessary supplies to the plates thereon are transferred via corresponding wiper devices to conductive lands at the frame of the screen which lead to the measuring points or scanning points, respectively, for supplying the signals to be represented. Here, too, however, it is again possible to provide register drivers, latches, etc. in the form of control modules on the element itself. For that purpose, the rim of the circular element for receiving these modules can be designed accordingly so that the disk surface as such can remain free.

The circular substrate arrangement in cooperation with the element which is turnable in its angular position and carrying the plates is excellently suitable for the use as a radar device as the synchronization between scanning and angular position of the element can simply take place mechanically.

In an advantageous embodiment of the invention it can furthermore be provided that the circular substrate and the circular, turnable element encompass a cavity filled with dielectric oil of high dielectricity constant in that in a manner known per se a lateral closing of the cavity under oil-proof seal is provided.

The invention will now be described in detail by means of embodiments, on the basis of the below listed drawings.

Figure 2:
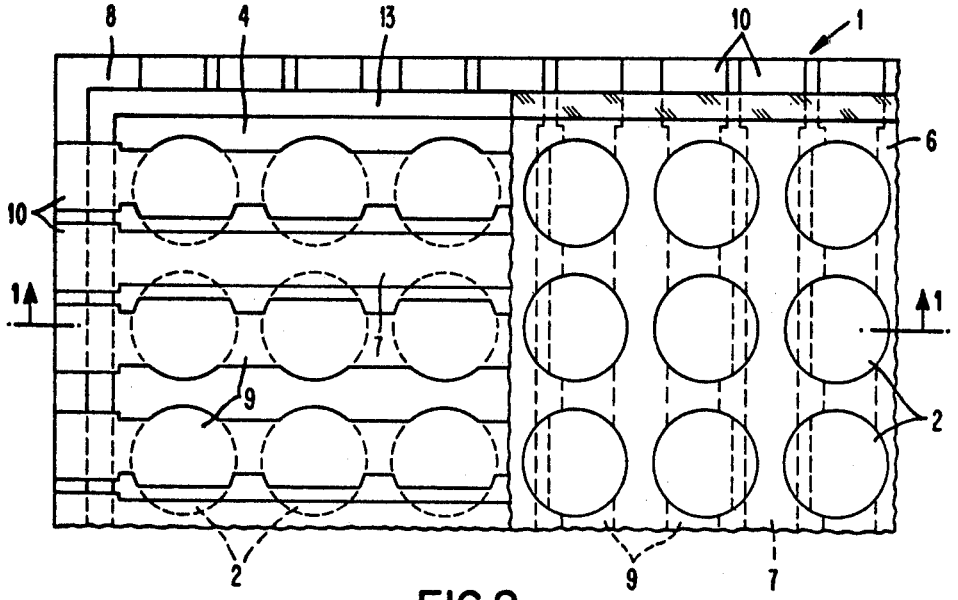
Figure 3:
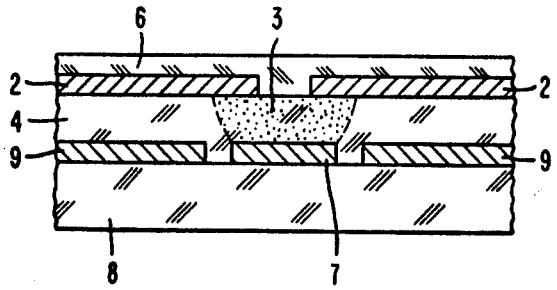
Figure 4:
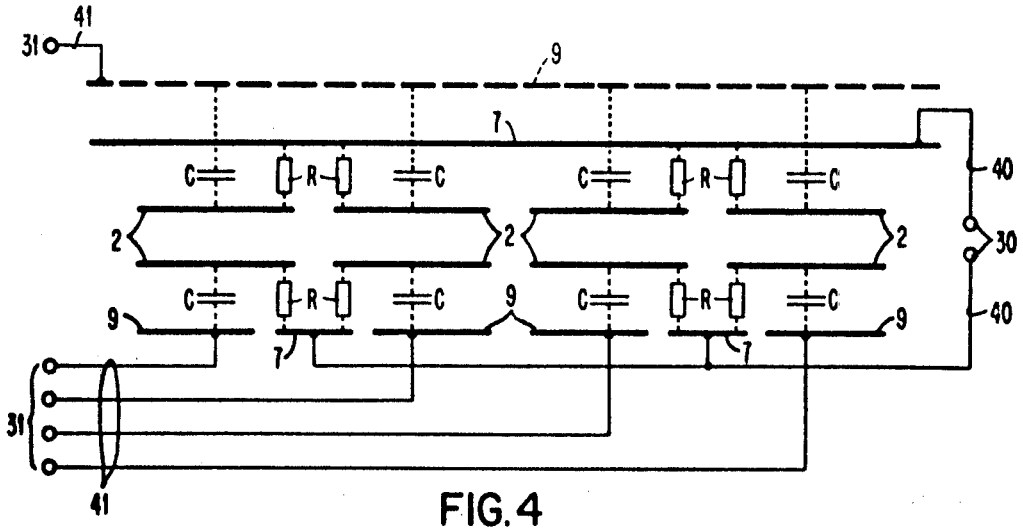
Figure 8:
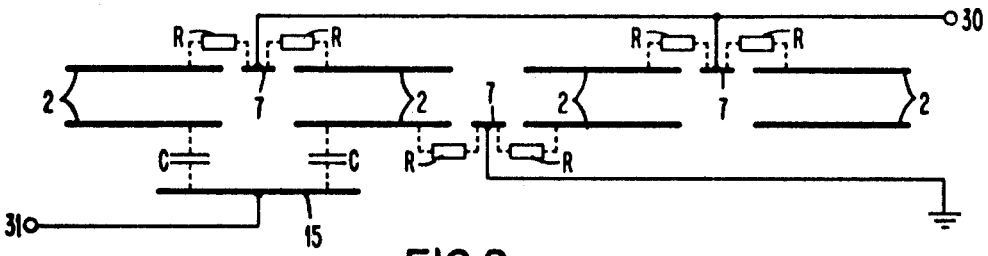
Figure 9:
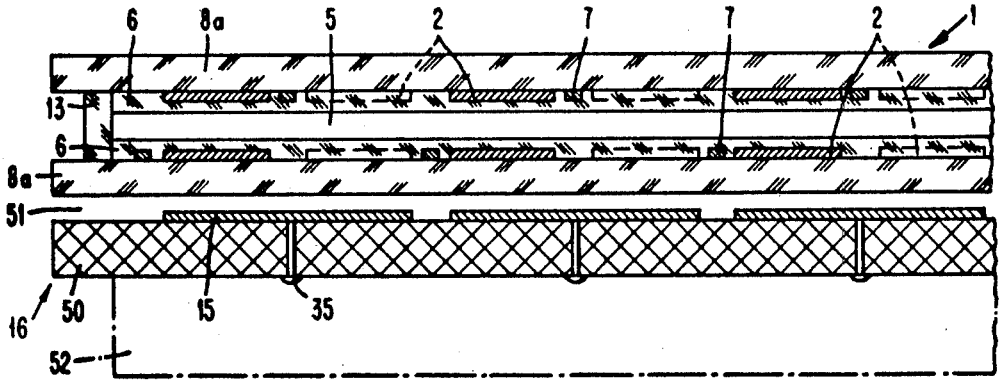
Figure 5:
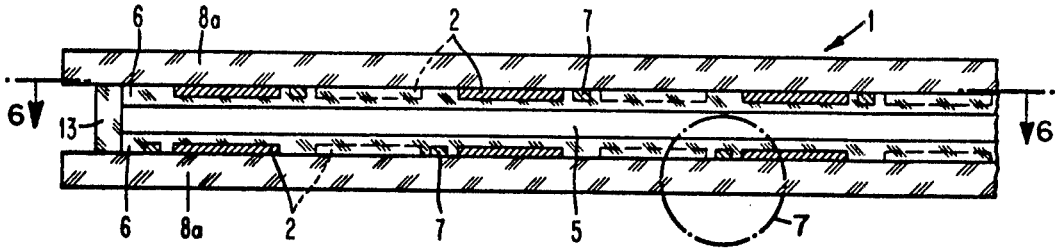
Figure 6:
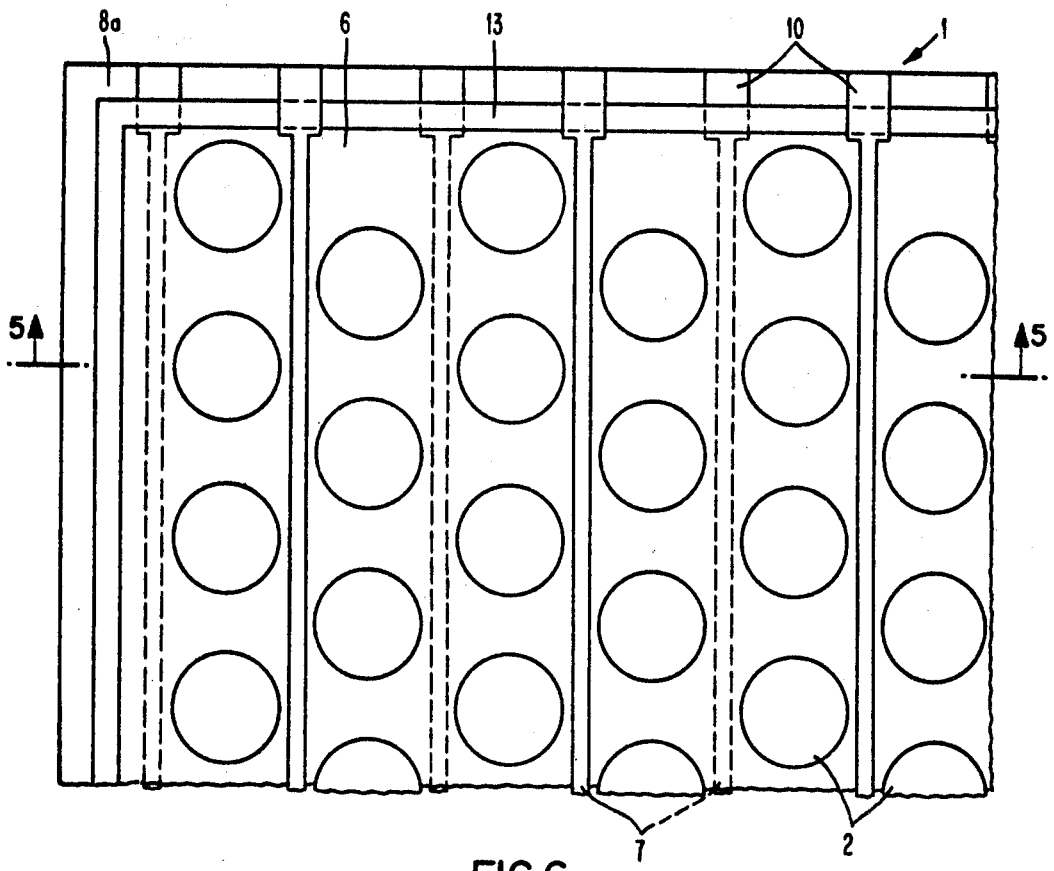
Figure 7:
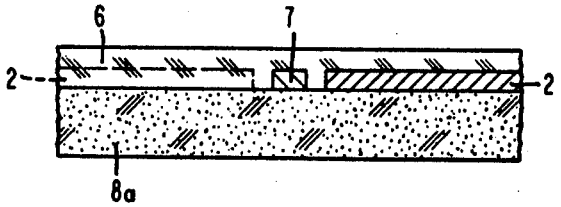
Figure 10:
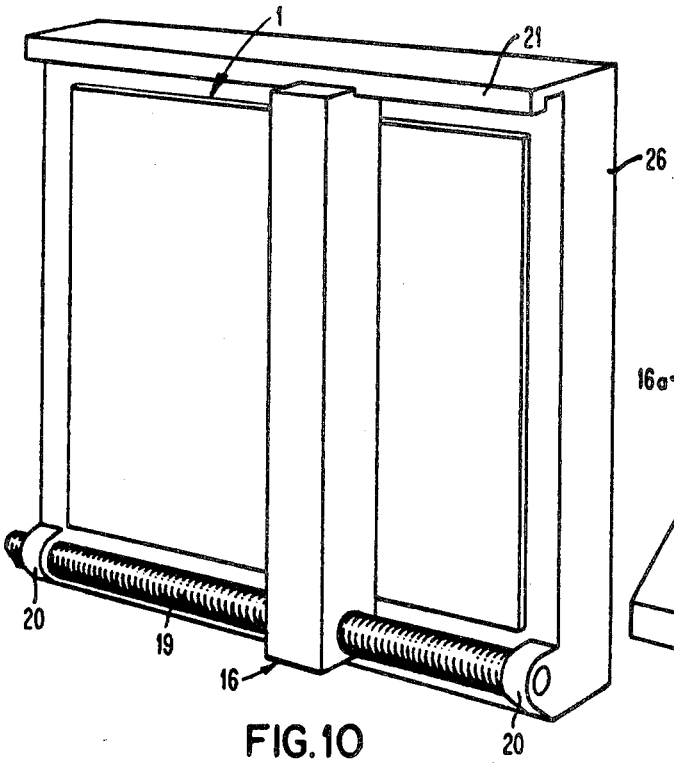
Figure 11:
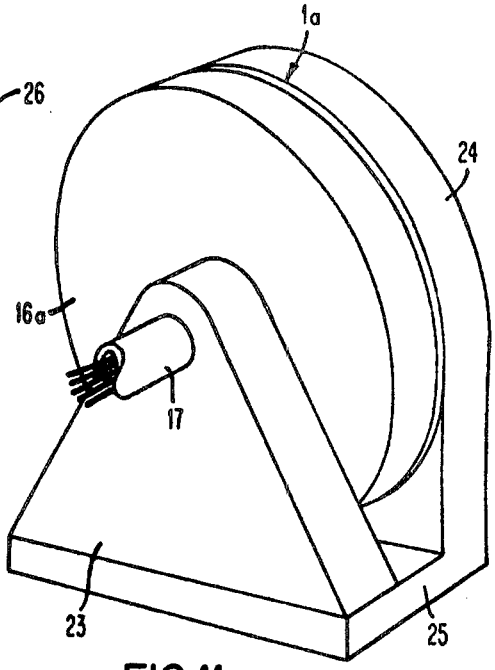
Figure 12:
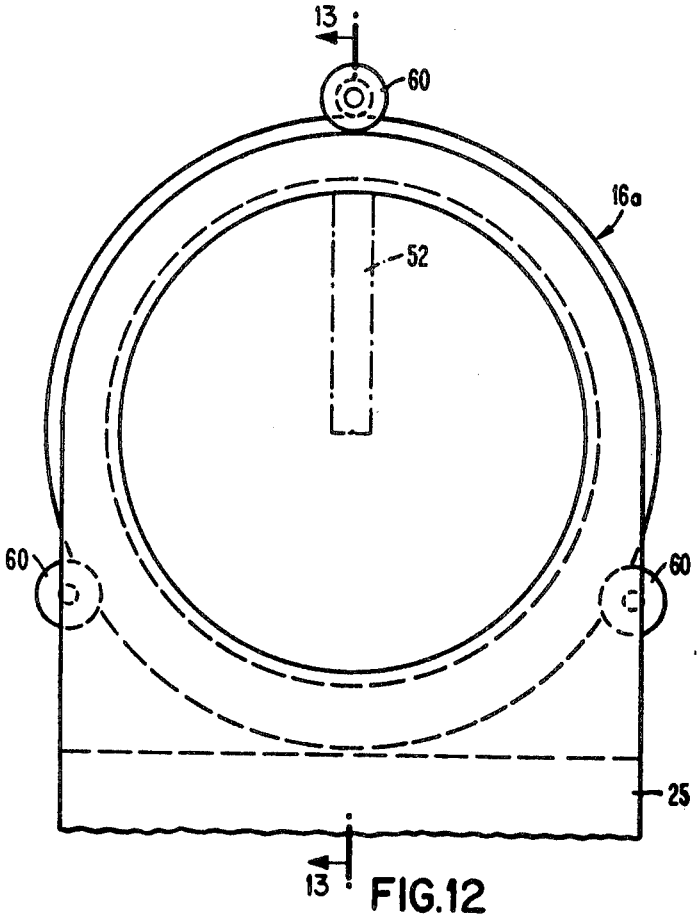
Figure 13:
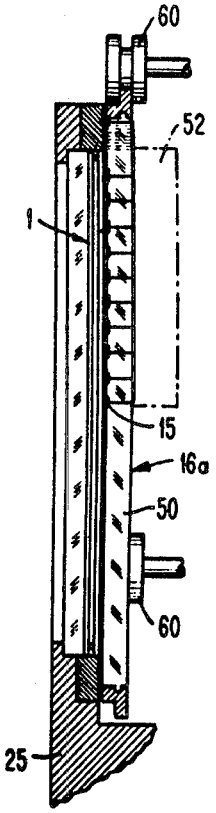

The drawings show the following:

FIG. 1 a sectional cross-section through a gas discharge display device in accordance with the invention, FIG. 2 a plan view section of the gas discharge display device taken along the lines 2-2 of FIG. 1, FIG. 3 an enlarged sectional view with a characteristic detail design in the cross-section according to FIG. 1, FIG. 4 an equivalent circuit diagram of the arrangement according to FIG. 1, FIG. 5 a sectional view of a cross-section of another embodiment of the invention, FIG. 6 a plan view section of the arrangement according to FIG. 5 taken along lines 6-6, FIG. 7 an enlarged section of the arrangement according to FIG. 5, FIG. 8 an equivalent circuit diagram of the arrangement according to FIG. 5, FIG. 9 a sectional cross-section of a third embodiment of the gas discharge display device according to the invention, where the circuit elements and components provided on the displaceable element are not shown for better understanding, FIG. 10 a perspective view of the third embodiment of the invention with rectangular substrate arrangement, FIG. 11 a perspective view of the third embodiment of the invention with circular substrate arrangement, FIG. 12 the arrangement of FIG. 9 with driving wheels required for the angular turning of the element, FIG. 13 a section through the arrangement shown in FIG. 12.

The cross-section of FIG. 1 shows the left-hand edge of the gas discharge display device of the invention, with the two electrically insulating substrates 8. These insulating substrates 8 can be made of glass as usual, only one of these substrates having to be transparent. By means of methods known per se, as e.g. the printed circuit technique, substantially parallel conductive lands 7 and 9 are applied on these substrates 8, the arrangement and design of such conductive lands being shown in detail in the representation according to FIG. 2. With conductive lands 7 and 9 being covered, one respective first dielectric layer 4 is applied on substrates 8, said layers showing locally limited zones 3 (FIG. 3) of low electric conductivity, as specified below. This first dielectric layer 4 carries the actual electrodes 2 which in the present embodiment are of circular design and which via the locally low-conductive electric zones are electrically coupled to the above described printed conductive lands 7 serving as sustain voltage supply lines. At least the electrodes on the transparent substrate are transparent and can consist of indium oxide or tin oxide. With electrodes 2 being covered, the first dielectric layers 4 each carry a second dielectric layer 6 for limiting the actual discharge chamber 5 of the gas discharge display device. These second dielectric layers 6 can e.g. consist of manganous oxide and serve for charge buildup caused by sustain voltage pulses supplied via sustain voltage supply lines 7, with successively alternating polarity, as it is of standard practice in arrangements of that type and described in detail in "IEEE Transactions on Electron Devices," Vol. ED-18, No. 9, September 1971, pp. 672 ff. The first dielectric layers 4 can also consist of glass which, in the area of the sustain voltage supply lines, in parallel thereto and contacting the electrodes 2 beneath, as shown in FIG. 3, comprises locally low-conductive zones 3 generated by doping or diffusion. Gas discharge chamber 5 is closed to the outside by means of sealing 13, said sealing being shown only schematically here.

Sustain voltage supply lines 7 and firing or extinguishing pulse supply lines 9 capacitively coupled to electrodes 2, of the conductive lands furthermore printed onto substrates 8 are equipped with connecting pieces 10 which outside gas discharge chamber 5 represent a respective extension of conductive lands 7 and 9 up to the substrate edges.

Although in the present embodiment a square or rectangular pattern of the electrode configuration is shown, other distributions can be employed, as e.g. the hexagonal electrode pattern of FIG. 6. In each case, however, electrodes 2 of the two substrates are arranged opposite each other, the printed conductive lands of the substrates of the present case being arranged orthogonally to each other so that a coordinate addressing of the gas discharge gaps formed by the electrodes is possible. The columns formed by the electrodes are equally spaced in each respective case, a sustain voltage supply line 7, as described above, being provided above two respective successive electrode columns in order to supply in that manner electrodes 2 of adjacent electrode columns via low conductivity zones 3 beneath with the sustain voltage or maintenance pulses, respectively. Above the electrode column the firing or extinguishing pulse supply lines 9 are provided.

As electrodes 2 and firing or extinguishing pulse supply lines 9 are arranged on opposite sides of dielectric layers 4, electrodes 2 are respectively capacitively coupled to these firing or extinguishing pulse supply lines 9, so that the firing as well as the extinguishing pulses can be transferred to electrodes 2 and thus to the individual gas discharge gaps.

In order to increase the capacity to the respective electrodes 2 the firing or extinguishing pulse supply lines show at the points respectively opposite to electrodes 2 planar extensions which are substantially adapted to electrodes 2 in their design and thus represent effective counter plates 11 for the generation of coupling capacities to the individual gas discharge gaps. As on the other hand, however, there is to be a resistance connection of sustain voltage supply line 7 between two firing or extinguishing pulse supply lines 9, and the respectively associated electrodes electrodes 2 to the right and left thereof, and as furthermore the firing or extinguishing pulse supply lines are to be electrically isolated from the sustain voltage supply lines an effective distance must be maintained between counter plates 11 and sustain voltage supply lines 7. For that reason, counter plates 11 are limited in their extension at the sides towards sustain voltage supply lines 7, and consequently represent circular sectors.

As pointed out already conductive lands 9 and 7 are extended into connecting pieces 10 at the respective substrate edges, so that connecting means are provided at the voltage and pulse sources, which are not shown here, for firing and extinguishing pulses as well as for sustain voltage.

If the effect of the wall charges is not be be made use of, i.e. in so-called direct voltage operation of the gas discharge display device, no second dielectric layers 6 covering electrodes 2 have of course to be applied on first dielectric layers 4.

The operation of the arrangement according to the invention is to be described on the basis of the equivalent circuit diagram of FIG. 4 where only conductive lands 7, 9, electrodes 2, coupling capacities C, and equivalent resistors R for the resistance-connections of the gas discharge data display device are shown. Connected to terminals 30 there is a sustain voltage pulse source which via lines 40 applies pulses with respective successively alternating polarity to the gas discharge gaps defined by electrodes 2. The pulse succession frequency is a function of the firing and extinguishing conditions of the gas discharge gaps. The amplitude of the thus applied sustain voltage pulses does not suffice to ignite the discharge gaps, but by means of the superposition of the sustain voltages on the wall voltages which with once fired discharge gaps accumulate at the dielectric layer 6, these gaps are continuously re-ignited upon the respective polarity inversion of the sustain voltage, as already specified above.

In the equivalent diagram according to FIG. 4, firing and extinguishing pulses are transferred via terminals 31 and supply lines 41 to firing or extinguishing pulse supply lines 9. While these firing or extinguishing pulse supply lines 9 are coupled via capacities C to electrodes 2, sustain voltage supply lines 7 are connected to these electrodes 2 via resistors R realized by the low-conductive zones 3. Dielectric layers 4 supplying coupling or resistor regions C and R between firing and extinguishing pulse supply lines 9, or sustain voltage supply lines 7 and electrodes 2, permit this in that they are designed accordingly, as described above. The well insulating zones of dielectric layers 4 should each have a dielectricity constant which is as high as possible. The low conductivity zones in layer 4 beneath sustain voltage supply lines 7 can easily be provided by means of corresponding doping with standard processes. Thus the advantage according to the invention is achieved, i.e. that the individual electrodes, with effective decoupling, are connected therebetween at the sustain voltage supply lines and at the firing or extinguishing pulse supply lines.

It should also be stressed that the gas discharge gaps cause neither disturbancies nor misfirings at crossing points of sustain voltage supply lines 7 on upper substrate 8 with those on lower substrate 8, as here via supply lines 7 the sustain voltage alone is applied, and as there exists no sufficient capacitive coupling to firing or extinguishing pulse supply lines 9. Even low light emissions are not detectable at these positions.

The embodiment of FIG. 6 shows another means of realizing the invention. It represents the plan view of a gas discharge display device with removed upper substrate 8, in a sectional view. Here, electrodes 2 embedded in the second dielectric layer 6 for supplying the wall charges are shown. On the same plane supply lines 7 for the sustain voltage pulses are embedded. While the throughgoing lines represent sustain voltage supply lines 7 inserted in upper second dielectric layer 6, the broken lines represent those in second dielectric layer 6 beneath limiting the gas discharge chamber toward the other side. As the counter-electrodes respectively associated to shown electrodes 2 are arranged precisely beneath, they do not appear in the drawing. Furthermore this drawing shows that electrodes 2 do not have to be arranged, either, in a standard rectangular configuration but that they can also be provided in a hexagonal pattern. This electrode pattern can be employed in order to effectively eliminate a disturbing line structure in image or character reproduction.

Finally, firing or extinguishing pulses can be applied to the respective desired gas discharge gap by means of capacitive coupling with counter-plates not shown here but arranged above or beneath substrates 8*a*.

On substrates 8*a* (FIG. 7), electrodes 2 and furthermore sustain voltage supply lines 7 are provided which are then embedded in the respective dielectric layer 6 provided thereabove. These substrates 8*a* made to be of a low conductivity nature by means of suitable doping, so that again a resistance connection is ensured from the respective sustain voltage supply lines 7 to the adjacent electrodes 2. The manufacture of the substrate arrangement in accordance with the invention is thus simplified still further.

Whereas therefore in the first embodiment the supply of electrodes 2 is performed by supply lines 7 placed above or beneath for the sustain voltage pulses, sustain voltage supply lines 7 and electrodes 2 are on one plane in the present embodiment so that lateral resistance zones in substrate 8*a* itself are effective between electrodes 2 and sustain voltage supply lines 7.

In a rectangular configuration of the electrodes as usual the firing and extinguishing pulse supply lines 9 can also be arranged orthogonally with respect to each other on both substrates 8*a*.

The manufacturing of the devices shown in FIGS. 5, 6, and 7 is of course much simpler than that of the device described first as here only one dielectric layer is needed beside the substrate. Here, too, the conductive lands as well as the electrodes can be applied on the substrates by means of processes known per se, as e.g. by printed circuit techniques.

The device as disclosed by the invention, in accordance with the last-described embodiment can be pulsewise addressed by a counter-plate 15 (FIG. 9) that can be arranged via the substrate surface to electrodes 2, in order to release a discharge at predetermined spots of the gas discharge display device, according to the position of the guided counter-plate 15. This kind of control may allow a talautograph process, or a light pen control as in the use of electron ray tubes.

If several plates 15 are arranged in a vertical row addressing is possible in that the row is shiftably provided in one coordinate direction and in that the other coordinate is determined by a corresponding selection of a plate in the vertical plate row. The operation is represented by the basic circuit diagram according to FIG. 8 where only the conductive elements are shown, as well as the equivalent resistors R and equivalent capacities C.

During operation, lower sustain voltage supply lines 7 are connected to ground potential, whereas upper sustain voltage supply lines 7 are fed via input 30 with the aternatingly opposite sustain voltage pulses. Via equivalent resistors R the correspondingly associated electrodes 2 then receive the respective potential. Counter-plate 15 which can be guided over the substrate surface is applied over input terminal 31 to the firing or extinguishing pulse source which can for instance be a measuring station or a scanning station. Through the applying on the substrate surface this counter-plate 15, according to its position, is capacitively coupled via the supplementary capacities to corresponding electrodes 2.

For the purpose of better understanding this drawing, as already mentioned above, does not show any of the insulating layers and insulating means, as e.g. the manually operable surface piece serving as counter-plate, as these details are quite obvious for one skilled in the art. The basic circuit diagram according to FIG. 8 is shown in considerable enlargement, the dimensions for counter-plate 15 being in reality so small that it can certainly be part of a pen.

Each gas discharge gap lying at the sustain voltage source over equivalent resistors R formed by a respective zone in upper and lower low-conductivity substrate 8*a*, said sustain voltage source being not shown here, is connected between terminal 30 and ground potential. Via terminal 31, and through series connected corresponding equivalent capacity C each between counter-plate 15 and electrodes 2, the respective discharge gaps are then fired or extinguished, respectively, by means of the firing and extinguishing voltage source connected thereto.

As already mentioned above, the last-mentioned device can also be used, apart from telautograph purposes, for a data display device where a successive columnwise excitation of the discharge gaps is executed, as shown e.g. in the drawing according to FIG. 10. In a shiftable member 16 (FIG. 9) a number of counter-plates 15 is provided which are arranged on the back of a gas discharge display device in order to be capacitively coupled to electrodes 2 beneath. There, air gap 51 between back substrate 8*a* and shiftable element 16 can be very narrow.

Shiftable element 16 consists in detail of substrate 50 carrying counter-plates 15, through-holes being provided in said substrate 50 for each counter-plate which each have a conductive connecting piece 35 reaching from one substrate surface to the other. In this manner, printed circuit modules or integrated circuit chips for presenting the respective circuits for the addressing of the gas discharge gaps can be arranged on the counter-plate, as described above, in order to restrict in this manner the necessary supply lines to element 16 to a minimum, i.e. substantially to the supply voltages and signals determining time. By means of a casing 52 the back of element 16 is covered to the outside. The supplies to the conductors on the substrate are arranged in the data display device itself and are arranged in a manner known per se.

With a suitable sealing the air gap between element 16 and back substrate 8*a* can also be filled with a dielectric oil of high dielectricity constant so that the distance between counter-plate 15 and substrate surface can be kept at a minimum.

On principle, such a display device with an element 16 carrying a series of counter-electrodes can be realized in two designs, i.e. on the one hand for the linear shifting of element 16, as shown in FIG. 10, for the representation in Cartesian coordinates, and on the other for the angular turning of element 16*a* for a representation in polar coordinates.

Whereas in the representation in Cartesian coordinates a rectangular or square configuration, respectively, of the electrodes on display device 1 seems advisable, a hexagonal configuration of electrodes 2 can be of greater advantage for the polar coordinate representation.

For the linear shifting of element 16, as shown in FIG. 10, a spindle 19 is used which is turnably mounted in bearings 20 and which via a corresponding counter-threading accordingly guides element 16 upon a turning motion. On the other hand, element 16 is shiftably arranged in a guiding 21 on data display device casing 26. The necessary electric connections to the gas discharge display device are not shown here, nor the necessary wiper connection to element 16 as this does not need further explanations since such means are well known to the expert.

In the polar coordinate representation arrangement, FIG. 11, a circular data display device 1 is arranged in a frame 24 fixed at a foot element 25, a hexagonal configuration of electrodes 2 being preferably employed, as already mentioned above. In accordance with the invention, this presents the advantage that all the sustain voltage supply lines of the display can be provided in parallel and that in the present case they can for instance extend vertically in downward direction, so that the corresponding electric connections thereat are made at foot element 25. Special means as required for radial arrangement of the lines, i.e. to provide connections also at the lateral screen edge in a relatively complicated manner, are therefore not needed.

As described above, counter-plates 15 are provided in a radial arrangement on substrate 52 which in this case is of circular design, the counter-plates being preferably arranged in one single row only. Counter-plates 15 are arranged at a minimum spacing from each other, and they do not necessarily have to show the same dimensions as electrodes 2; as shown already in FIG. 8 they can be much bigger than these electrodes 2. From case to case, however, the decisive factor in this matter is the resolution of the representation which is to be achieved.

Foot element 25 furthermore shows a casing 23 housing the bearing for hollow shaft 17 fixed to the rotorshaped slider 16. This casing 23 also contains wipers in a design known per se in order to be able to apply operating voltages to the circuit components arranged on rotor 16, as described above. The hollow shaft can be used for receiving signal lines for transmitting the firing and extinguishing criteria from a scanning or measuring station to rotor 16. As mentioned already, it is of advantage in such an arrangement that rotor 16 can be operated in synchronization with a scanning unit so that specific measures for the respective angular position representation are not necessary.

Rotor 16*a*, too, is of such a design that on a substrate 50, on the outwardfacing side, the integrated circuit chips or the printed circuit modules, respectively, are arranged which via through-holes 35 (FIG. 9) through the substrate are electrically connected to counter-plates 15 on the inner side of substrate 50. Making electrically conductive through-holes through insulating substrates takes place by means of methods known per se and therefore does not have to be described in detail here, either. Furthermore, it is inessential for the operation of the arrangement as disclosed by the invention whether counter-plates 15 are of square, rectangular, or circular shape.

For being able to maintain also in an arrangement of that type a minimum spacing between counter-plates 15 to electrodes 2 rotor 16*a* can be slidingly arranged on the corresponding surface of gas discharge display device 1, a dielectric oil of high dielectricity constant being filled in the correspondingly closed cavity between gas discharge display device 1 and rotor 16*a*, for eliminating the friction and for acting against corresponding wear.

When the arrangement as disclosed by the invention is used for radar display, to give an example, reflected pulses are represented in each angular position of rotor 16, counter-plates 15 being accordingly applied with firing and extinguishing pulses upon the presence or absence of reflected pulses. Via the capacities respectively generated by counter-plates 15 with corresponding electrodes the firing and extinguishing pulses, as mentioned above, are transferred to the respective gas discharge gaps. By means of the integrated circuits or the printed circuit modules, respectively, arranged on rotor 16*a* these firing and extinguishing pulses are derived from the respective reflected signals received by the antenna.

Owing to the easily performed synchronization between antenna and rotor 16 via hollow shaft 17 the otherwise required corrdinate calculation is not necessary here.

Furthermore, the selection or excitation, respectively, of the gas discharge gaps is not based on the coincidence of the reflected signals with superimposed control or synchronization signal amplitudes. This means that the tolerance problem with respect to the operation parameters, when the device as disclosed by the invention is used, is far less critical than in gas discharge display devices operated with phase-opposite sustain voltage pulses as well as firing and extinguishing pulses.

In the device according to FIG. 11 driving of rotor 16*a* takes place via hollow shaft 17. Another means is shown by the arrangement of FIGS. 12 and 13. The substrates in gas discharge display device 1 are again held by a frame 25. In a second frame which is not shown here for the sake of clearer survey three driving wheels 60 are preferably rotatably mounted, at least one of these being driven by a driving mechanism known per se and not shown, either. Driving wheels 60 have grooves in which moves a rim of rotor 16*a* in order to carry out by friction the angular turning of rotor 16*a*. At the same time, rotor 16*a* is kept thereby in its position relative to data display device 1. From plates 15 with the conductive throughholes through circular substrate 50 there extend connecting lines to the control modules supplying firing and extinguishing pulses and being supplied, via lines and sliding contacts at the brim of substrate 50 representing an essential part of rotor 16*a*, with operation voltages and timing signals. At the brim of substrate 50 the necessary connections can thus be provided, outside the field of view, which is of particular advantage in the projection of additional information on the display device from the back for the superposition with the image reproduced.

What is claimed is:

1. A gas discharge display device structure of the type having a discharge chamber containing ionizable gas sealed therein, said chamber enclosed by a pair of parallel planar layers held in an enclosing spaced relationship by a circumferential seal, said chamber containing a matrix of coordinate addressable discharge gaps formed by a plurality of pairs of electrodes, a first electrode of each pair of said pairs of electrodes being mounted on one layer of said pair of planar layers and said other electrode of said pair being mounted on the other layer of said pair of planar layers in juxtaposition to said first electrode, the improvement comprising:

at least some portion of said layers being of low conductivity and electrically connecting said electrodes to sustain voltage supply lines for decoupling capacitively induced firing voltages and extinguishing voltages generated on one of said electrodes from others of said electrodes which are also connected to said sustain voltage supply lines.

2. The structure of claim 1 wherein said electrodes are covered by a dielectric layer and wherein said sustain supply lines are each provided at each second space between colums of electrodes of said matrix of coordinate addressable discharge gaps in that two columns of electrodes are electrically connected to one of said sustain voltage supply lines by said portions of said layers of low conductivity.

3. The structure of claim 2, further comprising a firing and extinguishing pulse supply line capacitively coupled via said one layer of said pair of planar layers to each column of electrodes in one coordinate direction; and a firing and extinguishing pulse supply line capacitively coupled via said other layer of said pair of planar layers to each row of electrodes in another coordinate direction.

4. The structure of claim 3 wherein said sustain voltage supply line and said firing and extinguishing pulse supply line are mounted on said pair of parallel planar layers on opposite sides of said pair of parallel planar layers with respect to the mounting position of said electrodes.

5. The structure of claim 4 wherein said relationship between said first coordinate direction and said second corrdinate direction defining said matrix of coordinate addressable discharge gaps is orthogonal.

6. A gaseous discharge display device containing a discharge chamber wherein the gas discharge cells which define respective image point indications are selectively excited by coordinate addressing signals for igniting or extinguishing the discharge cells with a write or an erase signal, respectively, and wherein subsequent firings of already ignited gas discharge cells is provided by a sustain signal, the improvement wherein the respective discharge cells are defined by individual electrodes, one of said individual electrodes being connected through zones of low conductivity to at least one of the substrates encompassing said discharge chamber and to the sustain voltage supply line, the other of said individual electrodes being capacitively coupled through zones in a first dielectric layer on its associated substrate to the write and erase signal supply lines.

7. An arrangement as claimed in claim 6 wherein said electrodes are covered towards the discharge chamber by a second dielectric layer, each of said sustain voltage supply lines being provided at each second space between two electrode columns, said two electrode columns being associated with said sustain voltage supply lines.

8. An arrangement as claimed in claim 7 wherein parallel sustain voltage supply lines and write/erase signal lines are arrange on a non-conductive substrate, and wherein said first dielectric layer shows alternate highly insulated zones carrying said individual electrodes and said zones of low conductivity contacting the electrodes of two adjacent electrode columns.

9. An arrangement as claimed in claim 8, characterized in that the write and erase signal supply lines are provided above or beneath the electrode columns on said first dielectric layer and are extended planar-wise directly above individual electrodes to provide a maximum planar zone as a counterplate to the associated circular electrodes for forming respective coupling capacitances.

10. An arrangement as claimed in claim 9, characterized in that said substrate is of low conductivity and that said sustain voltage supply lines are coplanar with said electrodes on said substrate, said sustain voltage supply lines being arranged in parallel on each of said substrates and being arranged in an interleaved manner from said first substrate to said second substrate in alternate spaces between said electrode columns.

11. An arrangement as claimed in claim 6 characterized in that said electrodes are provided in a hexagonal configuration on said non-conductive substrate.

12. An arrangement as claimed in claim 10 characterized in that one of said sustain voltage supply lines is at ground potential on one of said substrates and that said electrodes on said one substrate serve as counter-plates for one of the plates coupled to said write and erase signal sources, said plates being provided on an element displaceably arranged on said substrate in a format which is substantially transverse to the displacement direction, thereby forming with the respective opposite electrodes coupling capacitance as a function of the position of said element.

13. An arrangement as claimed in claim 12 characterized by linear shifting of said element.

14. An arrangement as claimed in claim 12 characterized by angular displacement of a circular element towards the polar coordinate position.

15. An arrangement as claimed in claim 14 wherein said angular displacement of said circular element is provided via a coacting peripheral drive.

16. An arrangement as claimed in claim 15 characterized in that control modules for addressing the plates are arranged on said circular element.

17. An arrangement as claimed in claim 15 wherein the substrates are circular and said plates are radially arranged on a shiftable element.

18. An arrangement as claimed in claim 17 characterized in that said shiftable element comprises registers, latches and drivers for generating the respective write and erase signals positioned thereon.

19. An arrangement as claimed in claim 18 characterized in that one of said circular substrates and said circular element enclose a cavity filled with dieletrric oil having a high dielectric constant.

20. An arrangement as claimed in claim 10 characterized in that a counter-plate to one or several of said electrodes and laminar member connected to said write and erase signal source is adapted to be manually moved over said substrate surfaces.

* * * * *